United States Patent [19]

Paque

[11] 4,015,700

[45] Apr. 5, 1977

[54] TAPE ADVANCE MECHANISM

[75] Inventor: Michael W. Paque, Stillwater, Minn.

[73] Assignee: Kroy Industries Inc., Stillwater, Minn.

[22] Filed: Oct. 30, 1975

[21] Appl. No.: 627,079

[52] U.S. Cl. ..... 197/84 R; 101/288; 197/6.7; 226/164

[51] Int. Cl.[2] ..... B41J 1/28; B41J 19/58

[58] Field of Search ..... 101/18, 93, 288; 197/6.4, 6.7, 82, 84 R, 84 B; 226/164

[56] References Cited

UNITED STATES PATENTS

| | | | |
|---|---|---|---|
| 2,251,985 | 8/1941 | Coats | 226/164 |
| 2,985,352 | 5/1961 | Kuhlmann | 226/164 X |
| 3,067,677 | 12/1962 | Kask | 101/288 |
| 3,120,178 | 2/1964 | Lamers | 101/288 X |
| 3,391,773 | 7/1968 | Nicole et al. | 197/6.7 |
| 3,750,791 | 8/1973 | McReynolds et al. | 197/6.7 |
| 3,834,507 | 9/1974 | Bradshaw | 197/6.7 |
| 3,904,012 | 9/1975 | Friedel | 197/6.7 |

*Primary Examiner*—Edgar S. Burr
*Assistant Examiner*—Paul T. Sewell
*Attorney, Agent, or Firm*—Dorsey, Windhorst, Hannaford, Whitney & Halladay

[57] ABSTRACT

A mechanism for moving a tape through a printing apparatus in which said mechanism includes a back-space shuttle mounted to a frame for reciprocal movement and an advancing shuttle mounted to the back-space shuttle for reciprocal movement. Movement of the advancing shuttle in its operative direction by an advancing actuation arm of the printing apparatus causes the tape to be gripped by the advancing shuttle and advanced. The tape slips through the back-space shuttle during movement of the advancing shuttle in its operative direction. Movement of the back-space shuttle in its operative direction by a back space actuation slide of the printing apparatus causes the tape to be gripped by the back-space shuttle and back-spaced. The tape slips through the advancing shuttle during movement of the back-space shuttle in its operative direction.

21 Claims, 5 Drawing Figures

12
14
T
100
106
104
102
122
96
55
148
142
146
137
144
92
94
130
60
66
64
120
44
158
150
80
86
84
82
74
40
116
114
62
46
110,128
138
134
112
126
152
154
66
64
74
64
44
40
158

TAPE ADVANCE MECHANISM

BACKGROUND OF THE INVENTION

1. Field of the Invention

The present invention relates to a mechanism for moving a tape to be printed through a printing apparatus.

2. Description of the Prior Art

Printing apparatus of the type which prints characters on a tape which moves through the printing apparatus are well known in the art. The tape and a color carrier, such as a ribbon, pass through the printing station of the apparatus in printing registration with a selected raised character on a printing font. The font is mounted to the apparatus for rotation, and the particular character to be printed on the tape is placed at the printing station by rotating the font. Suitable pressure means forces the tape and the color carrier against the raised character on the font causing transfer of an image of the selected character to the tape. U.S. Pat. No. 3,834,507 discloses this particular type of printing apparatus.

In high quality printing apparatus of the type with which the present invention is intended to be used, the width of any given character differs from that of other characters. That fact can be appreciated by comparing, for example, the letter I with the letter W. Therefore, the apparatus should have means for advancing the tape through the apparatus different amounts between printing strokes, depending on the particular characters printed at each stroke, to improve the appearance of the printed tape.

The appearance of the printed tape can be improved even more if the apparatus has means for back-spacing the tape. Certain letters, when placed adjacent to each other, produce an optical illusion of being spaced a greater distance than other adjacent letters, even when that distance is in fact the same. In the art, this is known as "letter interlock". Take, on one hand, a situation in which the letters H and M are adjacent and spaced a given distance from each other and, on the other hand, one in which the letters A and W are adjacent and spaced that same distance from each other. The A and W will appear to be farther apart than the H and M because of the particular slope of their adjacent edges. With a back-space means, the operator can compensate for that illusion. For instance, assume that the advancing means produces the same spacing between all letters. An A has just been printed on the tape. If an H follows the A, then that spacing will be correct. However, if a W follows the A, then that spacing will appear excessive because of letter interlock. To compensate for this, the operator uses the back-space means before the W is printed, causing the W to be printed closer to the A.

The means for advancing and back-spacing the tape play a critical role in achieving the goal of proper letter spacing in the kind of printing apparatus which has been described. The final appearance of the printed tape depends heavily on how well the tape is positioned between printing strokes by the mechanism or mechanisms for advancing and back-spacing the tape.

SUMMARY OF THE INVENTION

It is an object of the present invention to provide a mechanism, for use in a printing apparatus of the type described, for moving the tape to be printed through the apparatus in predetermined, accurate increments. The particular type of mechanism with which the present invention is concerned is known and referred to by the inventor and those skilled in the art as a hitch feed mechanism.

In accordance with the present invention, the hitch feed mechanism comprises a frame for mounting the hitch feed mechanism to the printing apparatus and a shuttle. The shuttle includes a slide mounted to the frame for reciprocal movement in an operative and a return direction. The shuttle further includes a lever arm which is pivotally mounted to the slide for rotation relative thereto. The lever arm includes means for accepting a force from the printing apparatus in the operative direction of the slide, application of which force tends to rotate the lever arm in a first direction. The lever arm also includes means for accepting a force in the return direction of the slide, application of which force tends to rotate the lever arm in a second direction. The slide has a backing means and the lever arm a nipper for cooperating with the backing means to grip the tape therebetween and limit rotation of the lever arm member in its first direction. The slide and lever arm include stop means for limiting rotation of the lever arm in the second direction.

BRIEF DESCRIPTION OF THE DRAWINGS

The present invention can be more clearly understood by reference to the following detailed description read in connection with the drawings, in which like numerals refer to like parts throughout, wherein.

DETAILED DESCRIPTION OF THE INVENTION

Figure 1:
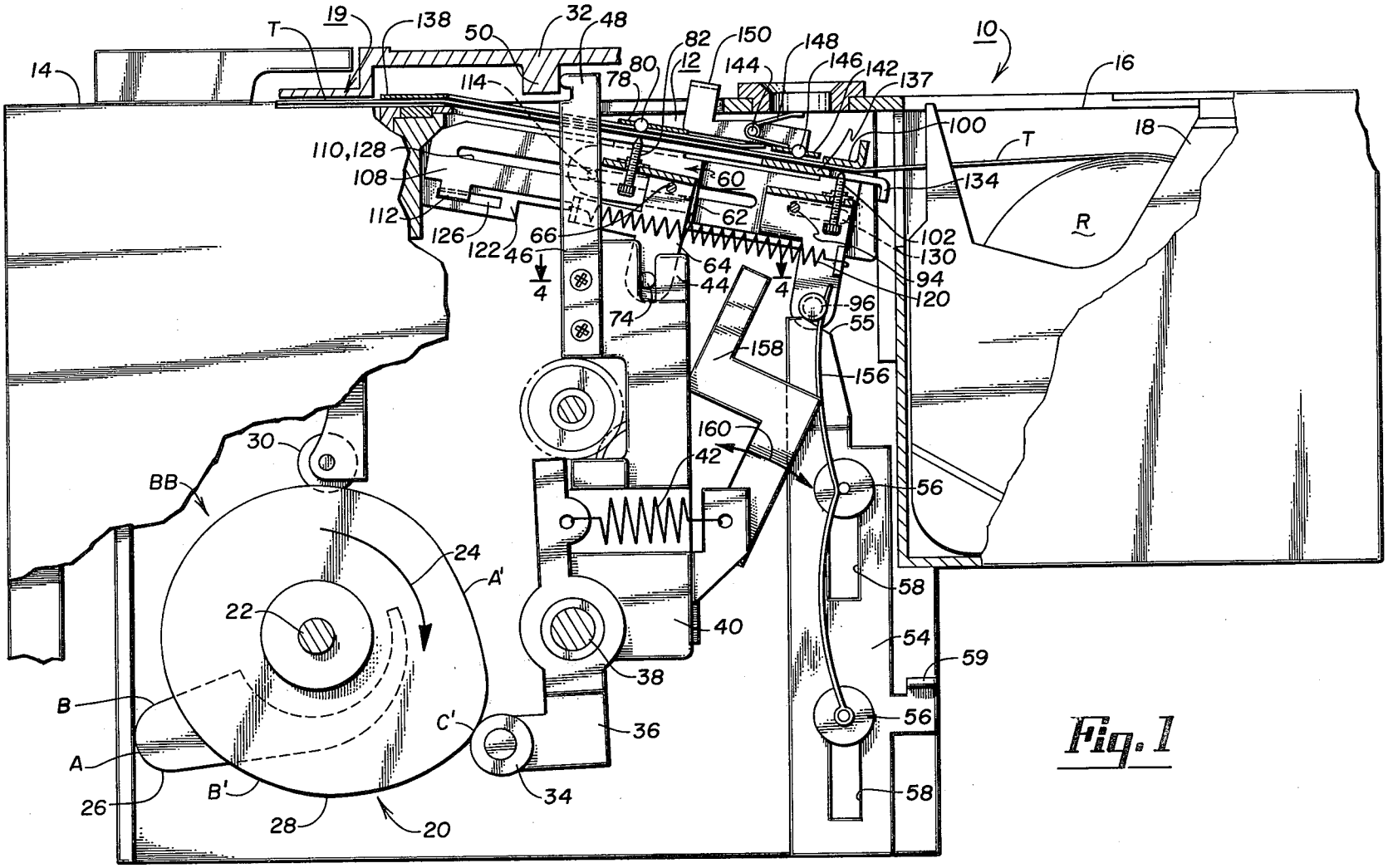
FIG. 1 is a plan view, partially in section, showing a printing apparatus incorporating the hitch feed mechanism of the present invention.

FIG. 1 shows a printing apparatus 10 incorporating a hitch feed mechanism 12 according to one embodiment of the present invention. Only those parts of the printing apparatus 10 relevant to the operation of hitch feed mechanism 12 will be described in detail here. The printing apparatus 10 comprises a structural frame 14 to which a tape well 16 is attached. A tape cartridge 18 fits within the tape well 16 and carries a tape reel R which is rotatably mounted to the cartridge 18 and which carries a length of tape T. The tape T extends from the reel R through the hitch feed mechanism 12 and from there to a printing station 19.

The printing apparatus 10 further includes a multi-surface cam wheel 20 which is secured to a shaft 22. A motor (not shown) rotates the shaft 22 and cam wheel 20 in the direction of the arrow 24 during a printing cycle. The cam wheel 20 has a first cam surface 26 which cooperates with a cam follower 30. A suitable linkage (not shown) connects the cam follower 30 to a pressure means (not shown) immediately under the printing station 19. A font element 32 having a plurality of raised characters on its underside is rotatably mounted to the frame 14. During operation, the character to be printed on the tape T is placed at the printing station 19 by manually rotating the font 32. The pressure means is actuated when the motor rotates the cam wheel 20, bringing the cam surface 26 into engagement with the cam follower 30. This causes the cam follower 30 and its linkage to rotate in a counterclockwise direction about its pivot point which is in the pressure means. The linkage connecting the cam follower 30 to the pressure means causes the pressure means to exert a force against the tape T. That force presses the tape T and the color carrying ribbon (not shown) against the aligned character on the font 32, printing that character onto the tape T.

The cam wheel 20 also has a second cam surface 28 which cooperates with a cam follower 34. The cam follower 34 is secured to a cam follower arm 36 which is rotatably mounted on the shaft 38. Also rotatably mounted on the shaft 38 is an advancing actuation arm 40. The follower arm 36 and actuation arm 40 are operatively connected by a spring 42 which causes the arm 40 to rotate counterclockwise upon similar rotation of the cam follower arm 36. The advancing actuation arm 40 includes a finger 44 at its upper end for cooperating with the hitch feed mechanism 12 to advance the tape T when the actuating arm 40 is rotated counterclockwise about the shaft 38. Rigidly secured to the actuation arm 40 is an indexing arm 46 which includes a stop member 48 at its upper end for cooperating with a spacing ring 50 formed in the font 32.

The printing apparatus 10 also includes a back-space actuator slide 54. A dual cam surface 55 formed by the upper end of the slide 54 cooperates with the hitch feed mechanism 12 to back-space the tape T upon upward movement of the back-space slide 54. A spring (not shown) biases the slide 54 downwardly. A pair of bosses 56,56 are rigidly secured to the frame 14 and cooperate with corresponding slots 58, 58 to mount the slide 54 for vertical reciprocal movement relative to the frame 14. The back-space actuator slide 54 moves upwardly when a back-space arm (not shown) presses against the flat tab 59.

Figures 1A, 3, 4:
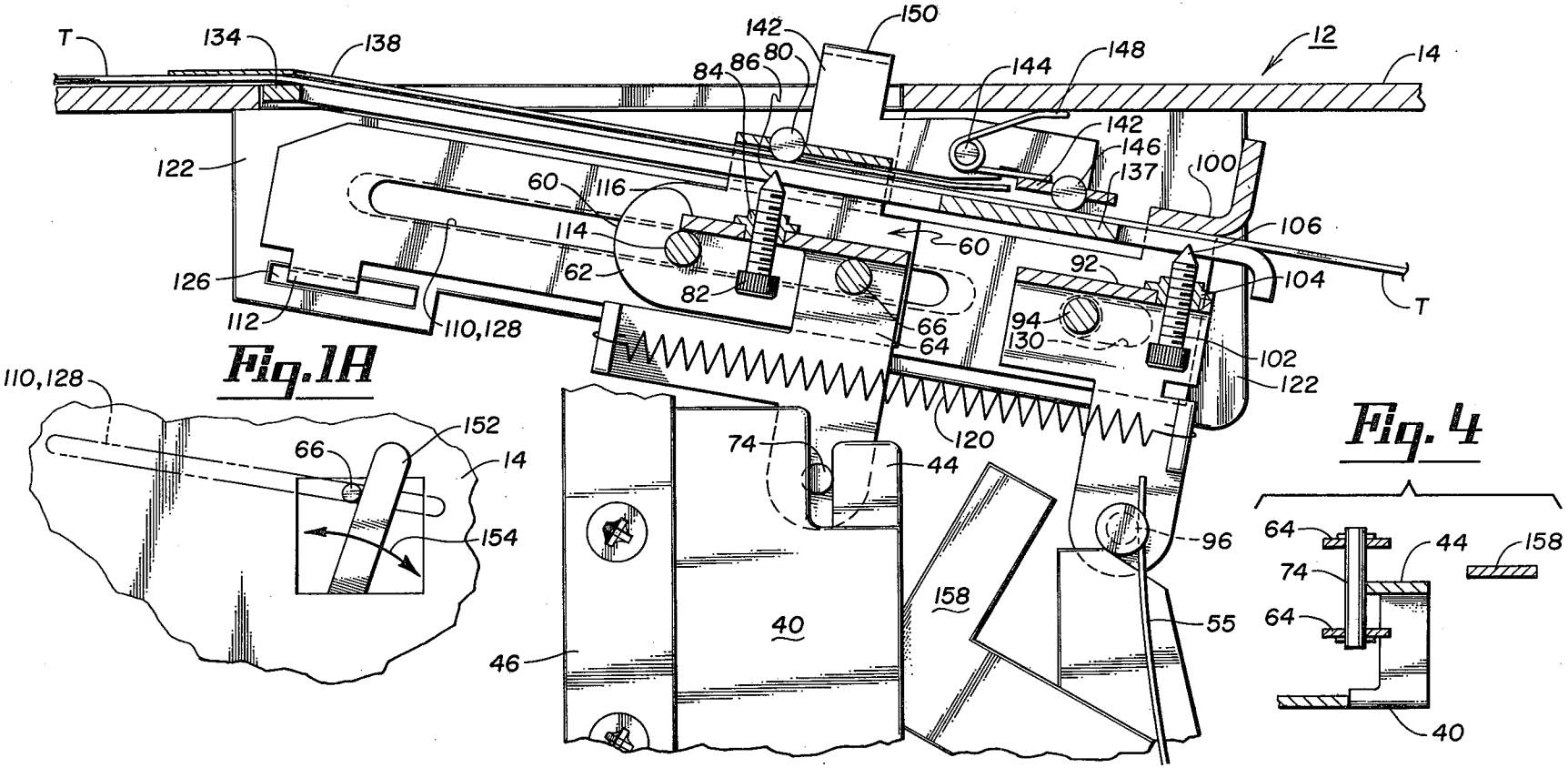
FIG. 1A is a detailed view of a portion of the printing apparatus shown in FIG. 1 with the relative position of the hitch feed mechanism of the present invention shown in phantom lines.
FIG. 3 is a plan view, partially in section, of the hitch feed mechanism of the present invention.
FIG. 4 is a sectional view taken along line 4—4 of FIG. 1.
Figure 2:
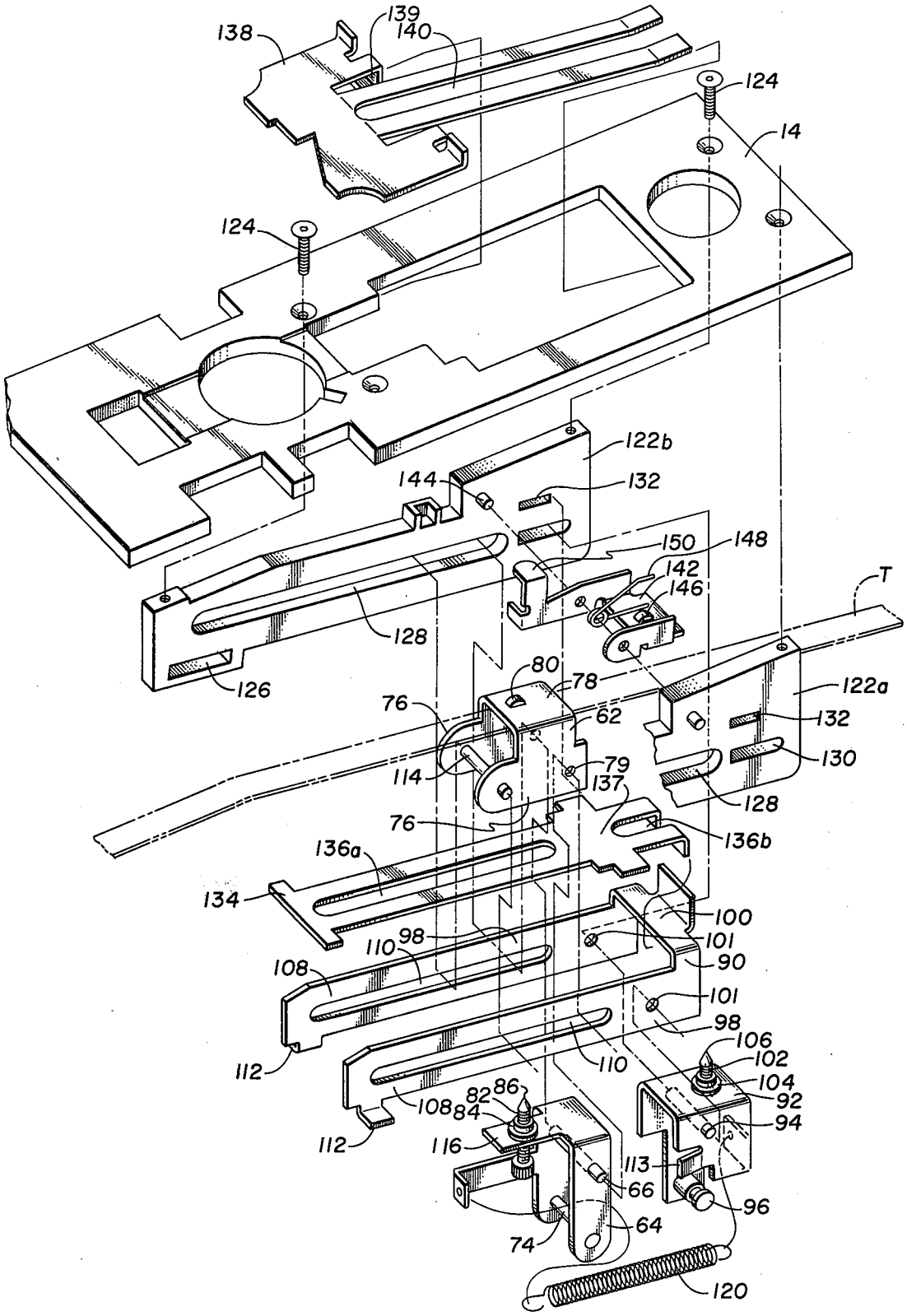
FIG. 2 is an exploded view of the hitch feed mechanism of the present invention.

Referring now to FIGS. 2 and 3, in addition to FIG. 1, the hitch feed mechanism 12 of the present invention comprises an advancing shuttle 60 for advancing the tape T through the printing apparatus 10. The advancing shuttle 60 includes an advancing slide 62 and an advancing lever arm 64 pivotally mounted to the slide 62 by a mounting rod 66. The advancing lever arm 64 includes an appropriate bearing member or force accepting means 74 which forms an actuation point for cooperation with, and accepting a force from, the finger or force exerting means 44 of the advancing actuating arm 40. The actuation bearing 74 is spaced from the mounting rod 66 so that movement of the bearing 74 rotates the advancing lever arm 64 about the rod 66. As shown in FIGS. 1, 3 and 4, it can be seen that the relationship between the finger 44 and the member 74 is such that the bearing member 74 is movable in the operative direction of the slide 62 independently of the finger 44.

The advancing slide 62 is a generally U-shaped member having two legs 76,76 and a bight portion 78. The advancing lever arm 64 is mounted between the legs 76,76 by the mounting rod 66, which extends between legs 76,76, through the holes 79, 79 and beyond the outer surface of legs 76,76. A disc 80 made of hardened material, such as carbide, is secured to the bight portion 78 such that the disc 80 extends beneath the bottom surface of bight portion 78 as seen in FIGS. 1 and 3. The advancing lever arm 64 includes a set screw 82 or similar element which is threaded through a bushing 84 secured in the advancing lever arm 64. The end of set screw 82 may be pointed as shown by reference numeral 86. Tape T, when in place, extends between the disc 80 and the point 86 of the set screw 82. The disc 80 forms an advancing backing means and the set screw 82 forms an advancing nipper for cooperating with the disc 80 to grip the tape T therebetween when the lever arm 64, and thus the screw 82 is rotated in a clockwise direction against the disc 80.

The hitch feed mechanism 12 also includes a back-space shuttle for back-spacing the tape T, which includes a back-space slide 90 and a back-space lever arm 92 pivotally mounted to the slide 90 by a mounting rod 94. The back-space lever arm 92 includes a back space actuation bearing 96 which forms an actuation point to be engaged by the cam surface 55 of the back-space actuator slide 54. The bearing 96 is spaced from the mounting rod 94 so that movement of the bearing 96 rotates the back-space lever arm 92 about the pivot axis formed by mounting rod 94.

The back-space slide 90 is a generally U-shaped element having two legs 98, 98 and a bight portion 100. The lever arm 92 is mounted between the legs 98,98 by the rod 94, which extends between legs 98,98 through holes 101, and beyond the outer surface of legs 98, 98. Operatively connected with the arm 92 is set screw 102, which is threaded through a bushing 104 secured in the lever arm 92. The end of set screw 102 may be pointed as shown at 106. The tape T extends between the bight portion 100 and point 106 of set screw 102. The bight portion 100 forms a back-space backing means and the set screw 102 forms a back-space nipper for cooperating with the bight 100 to grip the tape T therebetween when the lever arm 92 is rotated in a counterclockwise direction as viewed in the drawings.

The legs 98,98 of the back-space slide 90 includes mutually parallel, forwardly extending guide portions 108, each of which includes a guide slot 110 formed therein. The guide portions 108 also include outwardly facing L-shaped extensions 112 at their extreme ends for connection to the frame of the apparatus. The end portions of the mounting rod 66 extend into the guide slots 110 to guide the elements 62 and 64 along the slots 110. A guide rod 114 also extends between the legs 76 of the slide 62 and into the guide slots 110 to further guide movement of the slide 62 along the slots 110.

The portion of the guide rod 114 between the legs 76 and a tongue 116 function to limit counterclockwise rotation of the arm 64 about the pivot 66. A second stop means for limiting clockwise rotation of the back-space lever arm 92 is formed by engagement between a protruding portion 113 of the arm 92 and the bottom edge of one of the legs 98 of the slide 90.

The mechanism 12 further comprises two mutually parallel frame members 122a, 122b secured to the frame 14 of the printing apparatus 10 by a plurality of countersunk screws 124. The frame members 122a and 122b include a first pair of mutually facing slots 126 which form a first elongated track means and a second pair of mutually facing slots 130 which form a second elongated track means. The back-space shuttle which is composed of slide 90 and back space lever arm 92 is mounted between the frame members 122a and 122b for reciprocal movement by the L-shaped extension 112, which fit within the slots 126, and by the end portions of the mounting rod 94, which fit within the slots 130. Each of the frame members 122a, 122b also includes an elongated slot 128 coinciding respectively with guide slots 110 in the slide 90. It should be noted that the mounting rod 66 and the guide rod 114 are long enough to extend into the elongated slots 128. A spring or force exerting means 120 extends between a tab on the backspace lever arm 92 and a similar tab or force accepting means on the advancing lever arm 64 biasing the arms 64 and 92 toward rotation in a counterclockwise and clockwise direction, respectively, and also biasing the arms 64 and 92 together.

The frame members **122*a*, 122*b* also include mounting slots 132 for a supporting plate 134. The supporting plate 134 has a central slot 136*a* and 136*b*, interrupted near one end by a spanning portion 137, the ends of which extend into the slots 132. The plate 134 supports the tape T during its movement through the hitch feed mechanism 12. The set screw 82 is designed to extend through the left-hand portion 136*a* of the slot to grip the tape T during advancement, and the set screw 102 is designed to extend through the right-hand portion 136*b* and grip the tape during back-spacing. A cover plate 138 is secured to the frame 14 by a spring tab 139 and overlies the tape T. The cover plate 138 also has a central slot 140 aligned with the slot 136 to permit engagement between the disc 80** and the tape T.

Associated with the rear end of the hitch feed mechanism 12 is a tape tension control for holding the tape T when it is being neither advanced nor back-spaced. The tape tension control comprises a spanning plate 142 which extends between the frame members 122 above the tape T and a pair of rods 144 pivotally mounting the plate 142 to the frame members 122. The spanning plate 142 includes a disc 146 made of hardened material such as carbide, which is intended for contact with the tape T and which acts as a tension control nipper. This is accomplished by a spring 148 which continuously biases the disc 146 against the spanning portion 137. The tape T is thus loosely gripped between the disc 146 and spanning portion 137. The spanning plate 142 also includes a tab 150 which extends above the top of frame 14 for access by the apparatus operator. Pressing tab 150 pivots the spanning plate 142 about the pivots 144, permitting the tape to be threaded into the mechanism 12.

Various parts of printing apparatus 12 are operatively associated with the hitch feed mechanism 12. For example, as shown best in FIGS. 1 and 3, the advancing actuation arm 40 and the finger 44 cooperate with the actuation bearing 74 to move the advancing shuttle 60 to the left, as viewed in the drawings. As shown in FIG. 1, the back-space actuation slide 54 and cam surface 55 are designed to engage the bearing 96 to move the back-space shuttle to the right. An adjustable letter spacing arm 152, seen in FIG. 1A, cooperates with the end portion of mounting rod 66 which extends beyond the outer surface of frame member 122b to limit movement of advancing slide 62 to the right. FIG. 1A shows a partial view of the printing apparatus with the hitch feed mechanism 12 omitted showing the location of the letter spacing arm 152. A control (not shown) on the printing apparatus moves the spacing arm 152 in the direction of arrow 154 to selectively adjust the position of letter spacing arm 152 and thereby change the right-hand limit of travel of the advancing slide 62. The relative positions of the mounting rod 66, guide slots 110, and elongated apertures 128 are shown in phantom lines in FIG. 1A.

Referring again to FIG. 1, a leaf spring 156 cooperates with the back space actuation bearing 96 and with the bosses 56 to bias the lever arm 92 in a clockwise direction and the slide 90 toward the left. The end portions of the mounting rod 94 cooperate with the left-hand end of the slots 130 to limit movement of the back-space slide 90 toward the left. A word space lever 158 cooperates with the actuation bearing 74 to move the advancing shuttle 60 to the left. The word space lever 158 moves in the direction of arrow 160 (FIG. 1). The advancing shuttle 60 moves left independently of the advancing actuation arm 40 when the word space lever 158 is actuated because the finger 44 contacts the advancing actuation bearing 74 only on the right-hand side thereof as shown in FIG. 4.

The operation of the hitch feed mechanism 12 can best be understood by reference to FIG. 1 through 4 as follows. The tape T is threaded through the mechanism 12 by first removing any covering structure of frame 14 which is provided over the mechanism. This exposes the top of the mechanism 12 enabling the tape T to be easily fed through the mechanism. The operator first passes the tape T between the set screw 102 and the bight portion 100 of back-space slide 90 and then between the disc 146 and the spanning portion 137, which have been separated by depressing tab 150. Next, the tape is fed between the set screw 82 and disc 80 and finally, the tape T is fed through the mechanism between support plate 134 and the cover plate 138. The apparatus is then ready for operation.

At the start of any given printing cycle, the end portion of the mounting rod 66 rests against the letter spacing arm 152 (FIG. 1A), as the result of bias by the spring 120. The letter spacing arm 152 is set prior to initiation of a printing cycle, and will normally remain in the same position throughout the printing of any given tape. The position of the letter spacing arm 152 is set by a manual control (not shown) on the printing apparatus.

The operator then manually rotates the font 32 to place the desired character at the printing station 19. During this time, the cam wheel 20 is in its normal stopped position such that point A on the cam surface 26 is angularly located in the approximate area of the arrow BB and point A′ on the cam surface 28 is in contact with the cam follower 34. The operator then depresses a print key (not shown) and the motor rotates the cam 20 in a clockwise direction bringing point B of the cam surface 26 into contact with the cam follower 30. Further rotational movement of the cam 20 results in limited counterclockwise movement of the cam follower 30 and associated linkage about its pivot as the result of engagement between the follower 30 and the surface 26. Such movement of the follower 30 causes the pressure means to print the aligned character onto the tape T. As the cam 20 continues to rotate, the follower 30 is allowed to return to its normal rest position (shown in FIG. 1) as it passes point A of the surface 26, completing the printing portion of the printing cycle. The remaining movement of the cam 20 is used to feed the tape T and the color carrier (not shown) as described below.

During the printing portion of the printing stroke (when the cam surface 26 engages and moves past the follower 30), the cam follower 34 is in engagement with the cam surface 28 between points A′ and B′. This engagement, however, does not cause the hitch feed mechanism to operate. As point B′ of surface 28 approaches the cam follower 34, the pressure means (not shown) has returned to its rest position so the tape T and color carrier (not shown) are no longer being held in contact by the font 32 and are free to be moved or indexed their respective amounts.

When point B′ reaches the cam follower 34, the follower 34 begins to move toward the right, as viewed in FIG. 1, because the radial distance between the shaft 22 and the cam surface 28 begins to increase at point B′. This movement causes the cam follower arm 36 to rotate counterclockwise about the pivot 38 and, via the spring 42, transmits similar rotational movement to the actuation arm 40. As actuation arm 40 rotates counterclockwise, the finger 44 engages the actuation bearing 74 and moves it toward the left. Initial movement of the bearing 74 toward the left rotates the advancing lever arm 64 clockwise, or in its first direction of rotation, until the tape T is gripped between the set screw 82 and the disc 80. Further leftward movement of the bearing 74 causes the advancing slide 62 together with the element 64 to slide in the guide slots 110, thereby advancing the tape T in the process. The bearing 74 and associated apparatus thus comprises a means for accepting a force from the printing apparatus 10 in the operative direction of the advancing slide 62 and converting such force into the appropriate movement of the tape T.

As the advancing actuation arm 40 moves leftward, or in the operative direction of the advancing slide 62, the member 48 eventually contacts the ring 50 on the underside of font 32. The ring 50 has a predetermined configuration which controls and limits the distance which the arm 40, and therefore the tape T is moved during a printing cycle. If the letter just printed was a W, the ring 50 would permit the tape T to be advanced a greater amount than if the letter just printed was an I. The spring 42 permits overtravel of the cam follower arm 36 after the ring 50 has been contacted by the stop member 48. Such arrangement insures positive contact of the tab 48 with the ring 50 and allows for different amounts of tape advance even though the cam surface 28 moves the cam follower arm 36 the same distance during every printing cycle.

As point C′ on the cam surface 28 moves past the follower 34, the radial distance between the cam surface 28 and shaft 22 decreases causing the arm 36 to pivot in a clockwise direction. During this movement, the spring 120, which constantly biases the advancing lever arm 64 in a counterclockwise direction, causes the tape T to be disengaged by the set screw 82 and disc 80 and causes the advancing slide 62 to move toward the right, or in its return direction. Such movement continues until the mounting rod 66 contacts the letter spacing arm 152. The spring 120, therefore, provides a force on the lever arm 64 in the return direction of the advancing slide 62 causing the slide 62 and associated apparatus to return to its initial position. It should be noted that rotation of the arm 64 via the spring 120 is limited as a result of engagement between the rod 114 and the tongue portion 116. It should further be noted that the spring or force exerting means 120 exerts its force on the tab of the arm 64 independently of the force exerting means 44 and urges the arm 64 toward counterclockwise rotation and urges both the arm 64 and the slide 62 in the return direction of the slide. At this point, the printing cycle is complete.

The operator uses the back-space means to physically move the tape T backwards only when it is necessary to compensate for certain letter combinations which, as the result of certain character configurations, optically appear to have excessive space between them. In operation, the back-space actuator slide 54 is moved upwardly by a manually operated back-space button (not shown) on the printing apparatus. During this movement, the cam surface 55 on the back-space slide 54 contacts the actuation bearing 96, causing rotation of the lever arm 92 in a counterclockwise direction until the set screw 102 and the bight 100 grip the tape T. Further upward movement of the slide 54 moves the slide body 90 to the right, or in its operative direction, in the slots 126 and 130. The back-space actuation bearing 96 thus forms a means for accepting a force from the printing apparatus in the operative direction of the back-space slide 90. Application of this force tends to rotate the back-space lever arm in a counterclockwise direction until the screw 102 and bight 100 grip the tape T. Continued application of this force via the surface 55 causes movement of the back-space slide 90 in its operative direction, carrying the tape along with it.

After the tape T has been back-spaced the proper amount, the operator releases the back-space button. Simultaneously, the spring 120 and the leaf spring 156 urge the lever arm 94 in a clockwise direction and toward the left. This movement disengages set screw 102 and bight 100 from the tape T and permits the slide 90 to return to its initial position in which the ends of the mounting rod 94 contact the ends of the slots 130. During return of the slide 90, clockwise rotation of the arm 92 is limited by engagement between the tab 113 and the side rail 98.

Movement of the advancing slide 62 during movement of back-space slide 90 is prevented as the result of the previously discussed engagement between the rod 66 and the letter spacing arm 152. Movement of the back-space slide 90 during movement of the advancing slide 62 is prevented by the end portions of the mounting rod 94 which contact the ends of slots 130.

The hitch feed mechanism of the present invention is inherently well-suited for use with a printing apparatus having interchangeable fonts with characters of various sizes and styles. If a font which prints larger characters is to be used, the tape will have to be advanced between printing strokes a greater amount than would be the case with smaller characters. The font with larger characters will include a spacing ring 50 which will permit longer travel of the advancing actuation arm 40, and therefore, of the advancing slide 62 during movement in its operative direction. The amount the tape is back-spaced can be controlled by the amount which the back-space actuation slide 54 is permitted to move upwardly.

As discussed above, the tape is advanced during movement of the advancing slide 62 in its operative direction. During this movement, the back-space slide 90 is held stationary and the tape slips through the back-space shuttle because of the springs 120 and 156 which constantly urge the lever arm 92 to rotate in its second clockwise direction. Following the tape advance, the advancing lever arm 64 is urged to rotate in its second or counterclockwise direction, and the advancing slide 62 is urged in its return direction, by spring 120. The tape is back-spaced during movement of the back-space slide 90 in its operative direction. During this movement the advancing slide 62 is held stationary and the tape slips through the advancing shuttle 60 because of the spring 120. The back-space shuttle is returned to its starting position by the springs 120 and 156 when the force supplied by the back-space actuation slide 54 is released. After the tape has been back-spaced, the subsequent printing cycle will print the character closer to the previously printed character by a predetermined amount which is controlled by an indexing plate (not shown).

During the return stroke of both the advancing shuttle 60 and the back-space shuttle, the tape T is not gripped and ideally will not be moved. However, without the provision of some means for holding the tape during such return strokes, it is possible for inadvertent movement of the tape to take place. That inadvertent movement is prevented by the tape tension control which comprises disc 146 and the spanning portion 137. During operative movement of the respective shuttles, the tape T is gripped much harder by the advance and the back-space nippers and backing means than by the tension control. Thus, the tape is dragged through the tension control during operative movement of the shuttles. The tape is not gripped by the shuttles at all during their return strokes, enabling the tension control to prevent movement of the tape.

The word space lever 158 (FIG. 1) advances the tape T between words or other groups of characters and provides sufficient leader on the tape T after printing has been completed to enable it to be cut and removed from the apparatus. A suitable control (not shown) is provided on the printing apparatus 10 to move the word space lever 158 counterclockwise, during which movement it contacts the actuation bearing 74 and advances the tape T in a manner identical to that by which advancing actuation arm 40 advances it. However, as best shown in FIGS. 1 and 4, the amount the tape is advanced is not limited by the ring 50.

Although only one specific embodiment of the present invention has been shown, those skilled in the art will perceive modifications which can be made without departing from the spirit of the invention. Therefore, it is intended that the scope of the present invention be dictated by the appended claims rather than by the description of the preferred embodiment.

I claim:

1. A mechanism for moving a tape to be printed through a printing apparatus, said mechanism comprising a frame for mounting said mechanism to the printing apparatus and a shuttle, wherein;

said shuttle includes a slide mounted to said frame for reciprocal movement in an operative direction and a return direction and further includes a lever arm pivotally mounted to said slide for rotation relative thereto;

said lever arm includes first force accepting means for accepting a force from the printing apparatus in the operative direction of said slide and first force exerting means for exerting a force against said first force accepting means, application of which force tends to rotate said lever arm in a first direction, and second force accepting means for accepting a force in the return direction of said slide and second force exerting means for exerting a force against said second force accepting means, application of which force tends to rotate said lever arm in a second direction and to urge said lever arm and said slide in the return direction of said slide;

said first force accepting means is movable in the operative direction of said slide independently of said first force exerting means;

said slide includes a backing means and said lever arm includes a nipper cooperating with said backing means to limit rotation of said lever arm in the first direction and to grip the tape therebetween; and said slide and said lever arm include stop means for limiting rotation of said lever arm in the second direction.

2. The mechanism recited in claim 1 wherein said nipper has a point for gripping the tape between said backing means and said point.

3. The mechanism recited in claim 1 wherein:

said slide is U-shaped, having two legs and a bight portion connecting said legs wherein said legs extend on either side of the tape and said bight portion spans one surface thereof;

said lever arm is pivotally mounted to said slide between said legs; and said backing means comprises said bight portion of said slide.

4. A mechanism for moving a tape to be printed through a printing apparatus, said mechanism comprising a frame for mounting said mechanism to the printing apparatus and a shuttle, wherein:

said shuttle includes a slide mounted to said frame for recriprocal movement in an operative direction and a return direction and further includes a lever arm pivotally mounted to said slide for rotation relative thereto;

said lever arm includes means for accepting a force from the printing apparatus in the operative direction of said slide, application of which force tends to rotate said lever arm in a first direction, and means for accepting a force in the return direction of said slide, application of which force tends to rotate said lever arm in a second direction;

said slide includes a backing means and said lever arm includes a nipper cooperating with said backing means to limit rotation of said lever arm in the first direction and to grip the tape therebetween;

said slide and said lever arm include stop means for limiting rotation of said lever arm in the second direction;

said slide is U-shaped, having two legs and a bight portion connecting said legs wherein said legs extend on either side of the tape and said bight portion spans one surface thereof;

said lever arm is pivotally mounted to said slide between said legs;

said backing means comprises said bight portion of said slide;

said bight includes a carbide disc; and said nipper has a point for gripping the tape between said point and said carbide disc.

5. The mechanism recited in claim 1 including means for limiting the movement of said slide in its return direction.

6. The mechanism recited in claim 5 having adjustable means for limiting the movement of said slide in its return direction and to provide variable spacing.

7. The mechanism recited in claim 1 including guide means for guiding said slide in its movement in an operative and return direction.

8. The mechanism recited in claim 7 wherein said guide means includes a pair of spaced apart frame members each having an elongated guide slot therein.

9. The mechanism recited in claim 1 having means for limiting the movement of said slide in its operative direction.

10. The mechanism recited in claim 1 wherein the force tending to rotate said lever arm in a second direction is a spring means.

11. The mechanism of claim 1 having a pair of tape guide elements for guiding the tape therebetween, each of said guide elements having an elongated, centrally located slot wherein said slots are aligned with each other and with said backing means and nipper and wherein said guide elements are positioned between said backing means and nipper.

12. A mechanism for moving a tape to be printed through a printing apparatus, said mechanism comprising a frame for mounting said mechanism to the printing apparatus, an advancing shuttle and a back-space shuttle; wherein:

said back-space shuttle includes a back-space slide, mounted to said frame for reciprocal movement in an operative direction and a return direction, having means for limiting movement of said back-space slide in the return direction;

said back-space shuttle further includes a back-space lever arm pivotally mounted to said back-space slide for rotation relative thereto in a first direction and a second direction;

said back-space lever arm includes means for accepting a force from the printing apparatus in the operative direction of said back-space slide, application of which force tends to rotate said back-space lever arm in its first direction, and means for accepting a force in the return direction of said back-space slide, which force tends to rotate said back-space lever arm in its second direction;

said back-space slide includes a back-space backing means and said back-space lever arm includes a back-space nipper cooperating with said back-space backing means to limit rotation of said back-space lever arm in its first direction and to grip the tape therebetween;

said advancing shuttle includes an advancing slide, mounted to said back-space slide for reciprocal movement in an operative direction generally opposite to the operative direction of said back-space slide and in a return direction generally opposite to the return direction of said back-space slide, having means for limiting movement of said advancing slide in its return direction;

said advancing shuttle further includes an advancing lever arm pivotally mounted to said advancing slide for rotation in a first direction opposite to the first direction of rotation of said back-space lever arm and in a second direction opposite to the second direction of rotation of said back-space lever arm;

said advancing lever arm includes means for accepting a force from the printing apparatus in the operative direction of said advancing slide, application of which force tends to rotate said advancing lever arm in its first direction, and means for accepting a force in the return direction of said advancing slide, which force tends to rotate said advancing lever arm in its second direction;

said advancing slide includes an advancing backing means and said advancing lever arm includes an advancing nipper cooperating with said advancing backing means to limit rotation of said advancing lever arm in its first direction and to grip the tape therebetween.

13. The mechanism recited in claim 12 further comprising a spring connected between said advancing lever arm and said back-space lever arm to provide the force tending to rotate each of said advancing and back-space lever arms in its respective second direction.

14. The mechanism recited in claim 12 including means for limiting the rotation of said advancing lever arm in its second direction and means for limiting the rotation of said back-space lever arm in its second direction.

15. The mechanism recited in claim 12 wherein:

said back-space nipper has a point for gripping the tape between said back-space backing means and said point; and said advancing nipper has a sharp point for gripping the tape between said advancing backing means and said point.

16. The mechanism recited in claim 12 further including a tape tension control comprising a tension control backing means having means for mounting said tension control backing means to said frame and a tension control nipper having means for mounting said tension control nipper to said frame, wherein said tension control nipper is biased toward said backing means for gripping the tape therebetween at a location between the extreme positions of said back-space nipper and backing means and of said advancing nipper and backing means.

17. The mechanism recited in claim 16 wherein:

said frame includes two parallel frame members having said advancing shuttle and said back-space shuttle mounted therebetween;

said mechanism further comprises a supporting plate disposed betweeen said frame members;

said supporting plate underlies the tape and includes an elongated central slot for accepting therethrough said advancing and said back-space nippers;

said supporting plate includes a spanning portion comprising said tension control backing means; and said tension control nipper includes a disc.

18. The mechanism recited in claim 12 wherein:

said advancing slide is U-shaped having two legs and a bight portion connecting said legs wherein said legs extend on either side of the tape and said bight portion spans one surface of the tape;

said advancing lever arm is mounted between said legs to said advancing slide by a mounting rod having end portions extending beyond the outer surface of said legs;

said advancing slide further includes a guide rod having end portions extending beyond the surface of said legs;

said advancing lever arm includes a tongue cooperating with said guide rod to limit the rotation of said advancing lever arm in its second direction;

said back-space slide is U-shaped having two legs and a bight portion connecting said two legs wherein said legs extend on either side of the tape and said bight portion spans one surface of the tape;

said back-space lever arm is pivotally mounted to said back-space slide between said second-mentioned legs; and said second-mentioned legs include mutually facing guide portions extending generally in the return direction of said back-space slide, said mutually facing guide portions including mutually facing guide slots for accepting therethrough the end portions of said mounting rod and said guide rod to mount said advancing slide to said back-space slide for reciprocal movement relative thereto.

19. The mechanism recited in claim 18 wherein:

said frame parallel frame members includes two having a first pair and a second pair of mutually facing elongated track means and a pair of elongated, mutually facing apertures;

said mutually facing guide portions of said back-space slide include outwardly facing L-shaped extensions;

said back-space lever arm is mounted to said back-space slide by a mounting rod having end portions extending beyond the outer surface of said legs of said back-space slide; and said back-space slide is mounted for reciprocal movement relative to said frame members by said L-shaped extensions, each of which extensions extend into one of said first pair of elongated track means, and by said end portions of said last-mentioned mounting rod, each of which portions extends into one of said second pair of elongated track means, wherein said elongated apertures in said frame members coincide with said slots in the guide portions of said back-space slide.

20. The mechanism recited in claim 12 in combination with a printing apparatus wherein said printing apparatus includes:

an advancing actuation arm, reciprocally movable in the operative and return directions of said advancing slide, cooperating with said means for accepting a force in the operative direction of said advancing lever arm to supply such force;

a back-space actuation slide reciprocally movable in a vertical direction and including a cam surface cooperating with said means for accepting a force in the operative direction of said back-space lever arm to supply such force, wherein the upward distance said back-space actuation slide moves determines the distance said back-space slide moves in its operative direction;

an adjustable letter spacing lever cooperating with said advancing slide to limit movement of said advancing slide in its return direction; and a back-space spring member cooperating with said back-space lever arm to supply a force to said back-space lever arm in the return direction of said back-space slide biasing said back-space lever arm to rotate in its second direction.

21. The combination recited in claim 20 wherein:

said printing apparatus further includes a character-carrying font having a spacing ring on the underside thereof;

said advancing actuation arm includes an indexing arm cooperating with said spacing ring to limit movement of said advancing actuation arm in the operative direction of said advancing slide;

said printing apparatus includes means for limiting the upward movement of said back-space actuation slide.

* * * * *